US005323626A

United States Patent [19]

Gazzarrini et al.

[11] Patent Number: 5,323,626

[45] Date of Patent: Jun. 28, 1994

[54] APPARATUS FOR THE THERMAL PRE-FIXING OF STOCKINGS OUTPUTTING FROM A CIRCULAR MACHINE

[75] Inventors: Vinicio Gazzarrini, Impruneta; Pier L. Migliorini, Terranuova Bracciolini, both of Italy

[73] Assignee: Solis, S.r.l., Florence, Italy

[21] Appl. No.: 24,662

[22] Filed: Mar. 1, 1993

[30] Foreign Application Priority Data

Apr. 10, 1992 [IT] Italy ..... FI92 A 00087

[51] Int. Cl.[5] ..... D04B 15/92

[52] U.S. Cl. ..... 66/149 S; 66/147; 34/565

[58] Field of Search ..... 66/147, 149 R, 149 S; 34/54, 57 R, 104, 105, 202

[56] References Cited

U.S. PATENT DOCUMENTS

| | | | |
|---|---|---|---|
| 3,367,041 | 2/1968 | Troope et al. | 34/54 |
| 3,648,054 | 3/1972 | Nance | 66/149 S X |
| 3,906,750 | 9/1975 | Routh et al. | 66/149 S X |
| 4,026,036 | 5/1977 | Tamaka | 34/54 |
| 4,312,608 | 1/1982 | Nakhle et al. | 66/149 S X |
| 5,005,381 | 4/1991 | Moss | 66/149 S |

FOREIGN PATENT DOCUMENTS

| | | | |
|---|---|---|---|
| 560349 | 10/1932 | Fed. Rep. of Germany | 34/104 |
| 2249911 | 5/1973 | Fed. Rep. of Germany | 66/149 S |
| 594084 | 5/1959 | Italy | 66/149 S |
| 680855 | 1/1965 | Italy | 66/149 S |
| 9350-A/90 | 3/1990 | Italy . | |
| 91A106 | 9/1991 | Italy . | |

*Primary Examiner*—Clifford D. Crowder
*Assistant Examiner*—John J. Calvert
*Attorney, Agent, or Firm*—McGlew and Tuttle

[57] ABSTRACT

An apparatus for the thermal pre-fixing of stockings directly from a circular knitting machine has a cylindrical treatment chamber with an inlet valve and an outlet valve and is connected to a hosiery knitting machine through a conduit an to a suction conduit to transfer the stockings. The chamber has a blade valve for the admission of air during the expulsion of the treated stockings, a by-pass conduit connected to each end of the chamber with the interposition of a valve, an optical sensor upstream of the treatment chamber for detecting the arrival of a stocking and a heat exchanger to heat the treatment air.

8 Claims, 4 Drawing Sheets

APPARATUS FOR THE THERMAL PRE-FIXING OF STOCKINGS OUTPUTTING FROM A CIRCULAR MACHINE

BRIEF SUMMARY AND OBJECTS OF THE INVENTION

The object of the present invention is to provide an apparatus for the continuously but individually-operated pre-fixing heat treatment of stockings outputting from a hosiery circular machine.

It is known to those skilled in the art that stockings made by circular machines must be pre-fixed, that is, subject to a slight heat treatment which reduces the time necessary for the elastic shrinkage of the fibres to take place. This facilitates the subsequent operations made on the stockings such as, the assembling, toe-sewing or application of a gusset to the pantyhose articles, by achieving a saving of yarn as well, and which reduces the possible formation of faults such as pulled threads and ladders which are likely to occur when the stitches are loose as they leave the circular machine.

An apparatus is also known from IT BS 91 A 106 for the pre-fixing treatment of stockings made by a circular machine which comprises two U-shaped chambers attached to each other and in a cross-like manner to make up a rotary unit rotating about a vertical axis so that, alternatively, one chamber is in the stocking-loading position, and the other is in the stocking-treatment position.

In this apparatus, the treatment takes place within a closed chamber where the stocking is put in a contracted condition. It appears to be inefficient because of lack of vapor exhaustion.

A further apparatus is known from IT 9350-A/90 for the thermal pre-fixing of stockings which comprises a cylindrical chamber having vertical axis and wherein the stocking is set to hang down, and wherein the separately generated hot air is circulated through a closed circuit.

This apparatus is quite complex and is thus of very high cost.

The main purpose of the present invention is to eliminate or heavily reduce the above mentioned drawbacks.

This result has been achieved, according to the invention, by devising an apparatus for continuously and individually-operated thermal pre-fixing of the stockings. The device comprises a cylindrical treatment chamber having a vertical axis and disposed downstream of a hosiery circular machine by which it is pneumatically fed, said apparatus being provided with:

- means for sensing the stocking coming from the circular machine;
- means for admitting the thus sensed stocking into the treatment chamber and holding it therein;
- means for heating the treatment air;
- means for ejecting the treated stocking out of the treatment chamber.

The advantages obtained from the present invention lie essentially in that it is possible to operate the stockings pre-fixing effectively and without requiring large amount of electrical power; that an apparatus according to the invention is of simple construction, acceptable cost and high reliability even after a long period of operation.

These and other advantages and characteristics of the invention will be best understood by anyone skilled in the art from a reading of the following description in conjunction with the attached drawings given as a practical exemplification of the invention, but not to be considered in a limitative sense wherein:

DETAILED DESCRIPTION OF THE INVENTION

Figure 1A:
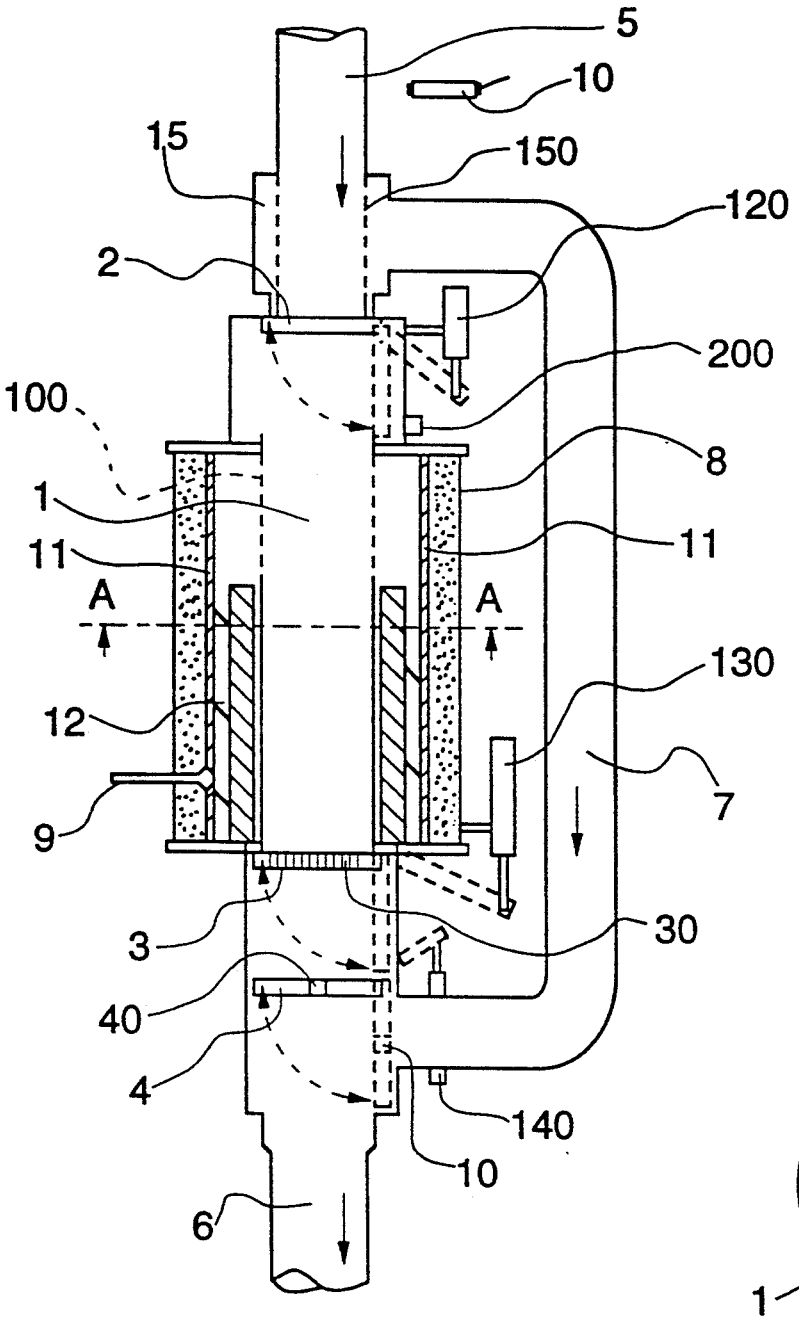
FIG. 1A shows a longitudinal section view of an apparatus for the pre-fixing of stockings, according to the invention.
Figure 1B:
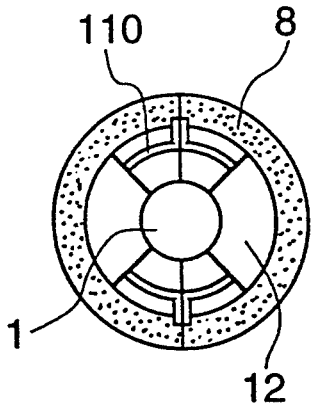
FIG. 1B shows a section on line A—A of FIG. 1A.
Figure 2:
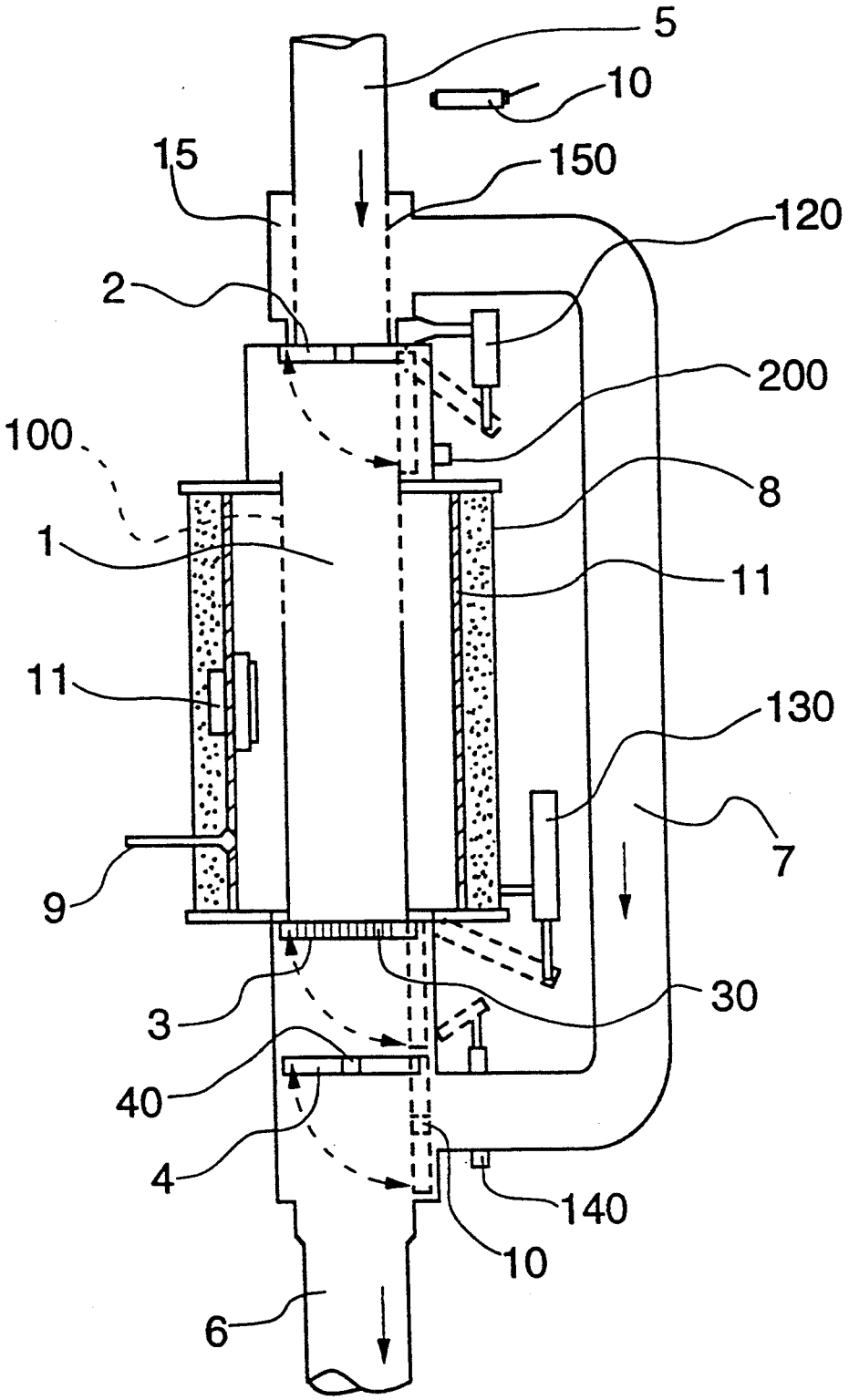
FIG. 2 shows a longitudinal section view of an alternative embodiment of the apparatus of FIG. 1B.

Reduced to its basic structure and with reference to FIGS. 1A–1B of the attached drawings, an apparatus for the individual pre-fixing of stockings outputting from a circular machine comprises:

a cylindrical treatment chamber (1) having vertical axis, with an inlet gate valve (2) associated to an operative cylinder (120), an outlet gate valve associated to an operative cylinder (130), and an normally closed blade valve (200) to allow—in the open condition—the admission of air into the chamber (1) during the ejection of the treated stocking, which chamber (1) is connected on one side, to a hosiery circular machine through a discharge conduit (5) and, on the other side via conduit (6), to a suction means, not shown for clarity, to transfer, one at a time, the stockings which come out from the circular machine;

a by-pass conduit (7), parallel to the chamber (1) which is connected, on one side, to an annular chamber (15) disposed upstream of the treatment chamber (1) and communicating with the stocking input conduit (5) through a plurality of holes (150) formed therein and, on the other side, to the discharge conduit (6) of the treated stockings, with the interposition of an intercepting gate valve (4) located donstream of outlet valve (3) of chamber (1), and which is in open and respectively closed condition when the valve is closed and respectively open.

During the treatment of a stocking within the chamber (1), the flow of aspirated air is directed from the conduit (5) to the conduit (6) through said conduit (7), while during the discharge of a treated stocking, the flow of aspirated air goes through the treatment chamber (1).

Said valve (4) is advantageously provided with an opening (40) to allow—in the open condition, that is, with the outlet opening of treatment chamber (1) bein closed—the disposal of vapors aspirated from chamber (1) during the treatment of the stocking; likewise, said outlet valve (3) of treatment chamber (1) is advantageously provided with a plurality of through holes to allow, in its closed condition, the expulsion of vapors drawn by suction during the treatment of the stocking;

an optical sensor (10) located upstream of treatment chamber (1) and whose axis intercepts said conduit (5) to sense the arrival of a stocking unloaded by the circular machine, which sensor operates the opening and respectively the closing of valves (2,3) of treatment chamber (1) and a valve (4) of the by-pass conduit thereby activating the corresponding operative cylinders (120,130,140);

an electric resistance (11) to heat the treatment air, which is located outside of chamber (1) but inside a body (110) coaxial to the chamber (1), made of infrared rays-treated ceramics to allow a more uniform heat distribution: said cylindrical body (110) being in turn disposed inside an insulated shell (8) with the interposition of a spiral chamber (12);

a nozzle (9) for the admission of treatment air, such as compressed air possible added with nebulized water, into the spiral chamber (2) which communicates with the treatment chamber (1) through a plurality of holes formed in the wall of said chamber (1).

Advantageously, according to the invention, a thermostat is provided, not shown in the figures of the attached drawings for sake of clarity, to keep the temperature inside the chamber (1) steady.

According to a first alternative embodiment of the present invention and with reference to the attached drawings, provision is made for a microwave generator, in place of said electric resistance (11), in order to heat the treatment air.

Figure 3:
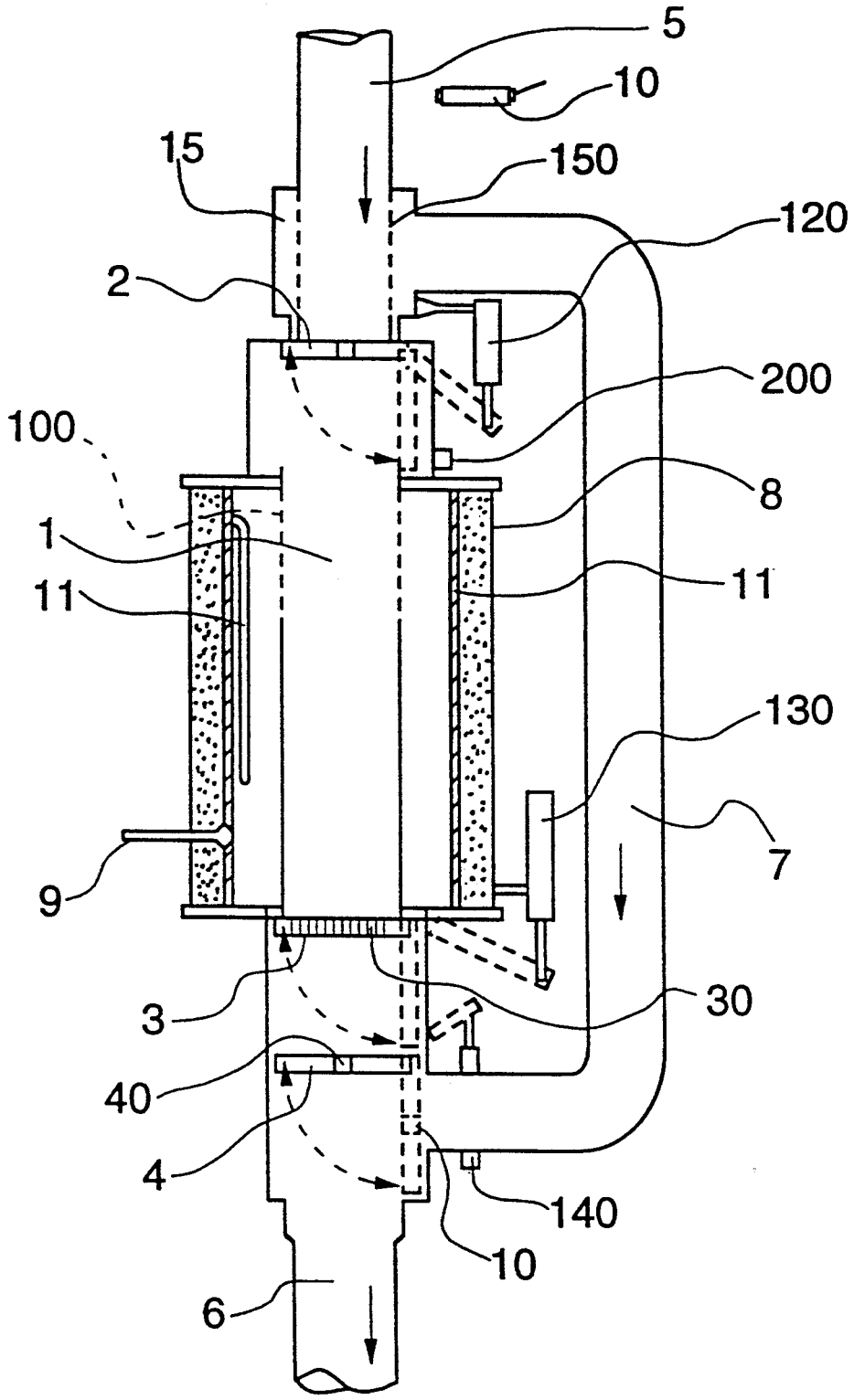
FIG. 3 shows a longitudinal section view of a second alternative embodiment of the apparatus of FIG. 1A.

According to a second alternative embodiment of the invention and with reference to FIG. 3 of the attached drawings, provision is made for an infrared rays generator (11) to heat the treatment air.

Figure 4:
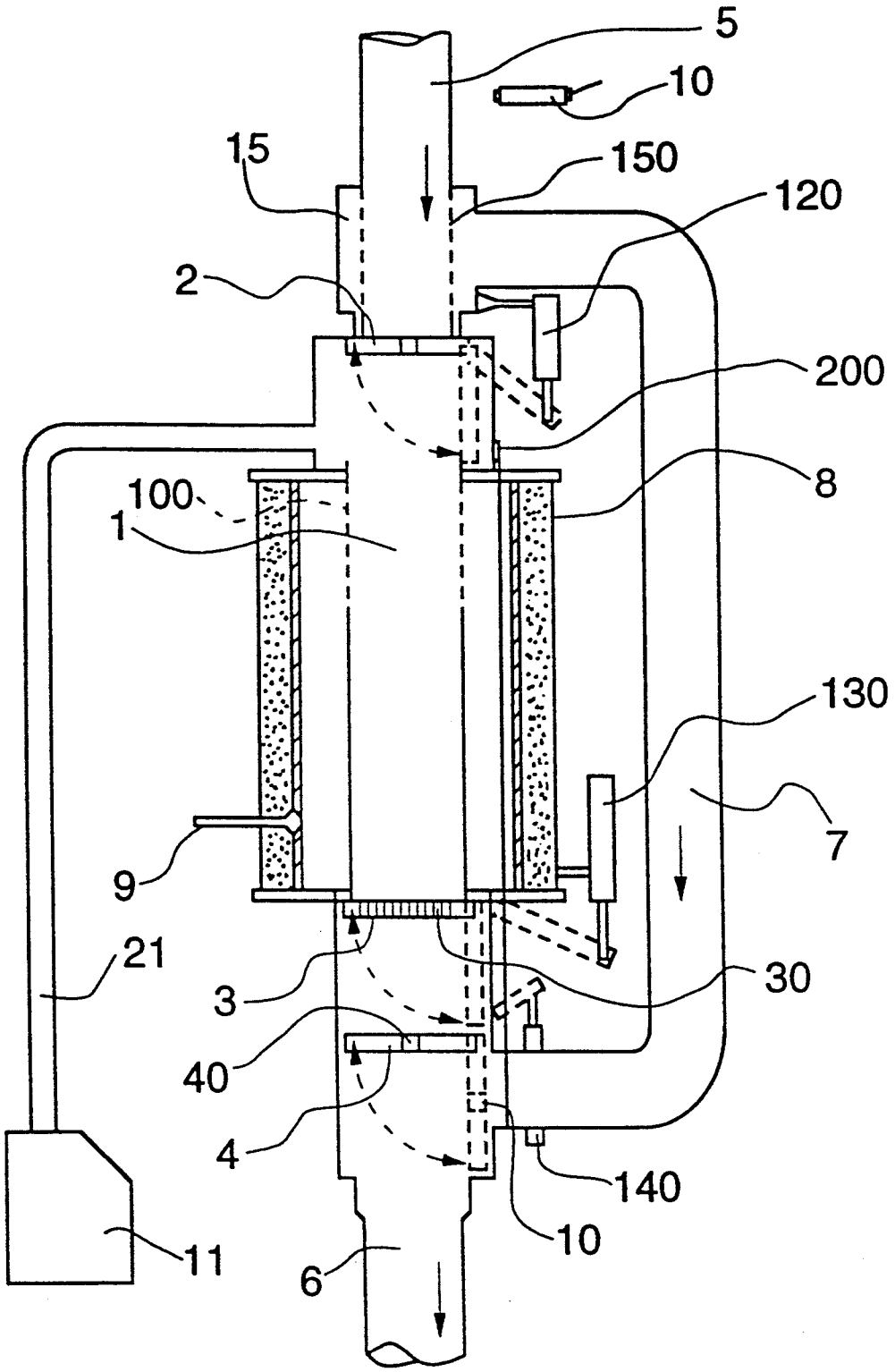
FIG. 4 shows a longitudinal section view of another alternative embodiment of the apparatus of FIG. 1A.

In addition and alternatively, reference being made to FIG. 4 of the attached drawings, the treatment of stockings inside the chamber (1) is operated by admitting hot air generated by a separate thermofan (11) therein through a conduit (21).

The operation under normal running conditions is as follows:

While a stocking is held inside the treatment chamber (1) with the valves (2) and (3) closed, the air fed by the nozzle (9) and heated by the resistance (11) hits the stocking, the vapors within the conduit (6) are drawn out by suction. At the same time, the suction inside the conduit (6) causes a suction effect within the conduit (5) through the by-pass (7). When a new stocking is discharged from the circular machine and goes into the conduit (5) in front of sensor (10), the latter causes the cylinder (140) to close the valve (4) of by-pass (7) and, simultaneously, the cylinder (130) to open the valve (3) of treatment chamber (1), so that the aspirated air, by flowing through the chamber (1), draws out the already treated stocking inside the conduit (6): the opening of blade valve (200) being operated by the vacuum thus provided inside the chamber (1) to let air in during the ejection of the treated stocking, and this in order to avoid the formation of a vacuum in the chamber (1) which would greatly hinder the ejection of the stocking. Immediately after, the valve (3) is closed and valve (2) is opened, so that the incoming stocking detected by the sensor (10) is made to enter from conduit (5) into chamber (1); thereafter the valve (2) is re-closed and valve (4) re-opened, and the cycle is repeated.

Practically, all the construction details may vary in any equivalent way as far as the form, dimensions, elements disposition, nature of the used materials are concerned, without nevertheless departing from the scope of the adopted solution idea and, thereby, remaining within the limits of the protection granted to the present patent for industrial invention.

What is claimed is:

1. Apparatus for thermal prefixing of stockings outputting from a circular knitting machine, comprising a cylindrical treatment chamber (1) having a vertical axis, an inlet valve (2) and an outlet valve (3) and connected, at one end, to a hosiery circular knitting machine through an input conduit (5) and, at the other end, to a suction means via a discharge conduit (6) so as to transfer, one at a time, the stockings outputting from the circular knitting machine, wherein the chamber (1) is provided with:

a normally closed balde valve (200) to allow, in an open condition, admission of air during expulsion of the treated stocking;

a by-pass conduit (7), parallel to the chamber (1) connected, on one end, to an annular chamber (15) disposed upstream of the treatment chamber (1) and communicating with the input conduit (5) through a plurality of holes (150) formed therein and, on the other end, to the discharge conduit (6), with the interposition of an intercepting gate valve (4) located downstream of the outlet valve (3) of the chamber (1), which gate valve is in an open and closed condition when the outlet valve is respectively closed and open;

an optical sensor (10) upstream of the treatment chamber (1), the sensor having an axis intercepting said input conduit (5) to detect arrival of a stocking being discharged by the circular knitting machine and controlling the opening and, respectively, the closing of the inlet and the outlet valves (2,3) of the chamber (1) and of the gate valve (4) of the by-pass conduit (7) through activation of corresponding operative cylinders (120, 130, 140);

means (11) to heat the treatment air, with an insulated chamber (12) acting as a heat-exchanger and communicating with the treatment chamber (1) through a plurality of holes formed in the wall of the chamber (1); and a nozzle (9) for admission of compressed air into the heat-exchanger (12) to supply hot air during the treatment of the stocking inside the chamber (1) and to dispose of generated vapors.

2. Apparatus according to claim 1, characterized in that the gate valve (4) is provided with an opening (40) to allow—in the open condition, that is, with the outlet opening of treatment chamber (1) being closed—the disposal of vapors aspirated from chamber (1) during the treatment of the stocking.

3. Apparatus according to claim 1, characterized in that the outlet valve (3) is provided with a plurality of through holes to allow, in its closed condition, the expulsion of vapors drawn by suction during the treatment of the stocking.

4. Apparatus according to claim 1, characterized in that said means (11) for heating the treatment air are made up of an electric resistance housed within a body (110) coaxial to but outside of the treatment chamber (1): said body (110) being made of infrared rays-treated ceramics.

5. Apparatus according to claim 1, characterized in that said means (11) for heating the treatment air consist of a microwave generator.

6. Apparatus according to claim 1, characterized in that said means (11) for heating the treatment air consist of an infrared rays generator.

7. Apparatus according to claim 1, characterized in that said means (11) for heating the treatment air comprise a thermofan with relevant conduit (21) for the admission of hot air within the treatment chamber (1).

8. Apparatus according to claim 1, characterized in that the chamber is provided with a thermostat to keep the temperature inside the chamber (1) steady.

* * * * *